United States Patent [19]

Kumm

[11] 4,157,229

[45] Jun. 5, 1979

[54] UNDER-ICE TRAVELING SHELTER SYSTEM

[75] Inventor: William H. Kumm, Severna Park, Md.

[73] Assignee: Westinghouse Electric Corp., Pittsburgh, Pa.

[21] Appl. No.: 815,388

[22] Filed: Jul. 13, 1977

[51] Int. Cl.[2] ..... B63C 11/00

[52] U.S. Cl. ..... 405/185; 114/312; 180/1 H

[58] Field of Search ..... 61/69 R, 69 A; 114/16 R, 222; 180/1 VS, 1 H, 9.2 R

[56] References Cited

U.S. PATENT DOCUMENTS

| | | | |
|---|---|---|---|
| 1,523,660 | 1/1925 | Reno | 61/69 R |
| 2,327,012 | 8/1943 | Bright | 114/222 |
| 3,543,526 | 12/1970 | O'Neill et al. | 61/69 R |
| 3,568,454 | 3/1971 | Itami | 61/69 R |
| 3,709,184 | 1/1973 | Laney | 114/222 |

FOREIGN PATENT DOCUMENTS

| | | | |
|---|---|---|---|
| 2003003 | 7/1971 | Fed. Rep. of Germany | 114/222 |
| 2311081 | 9/1973 | Fed. Rep. of Germany | 114/222 |

*Primary Examiner*—Mervin Stein
*Assistant Examiner*—David H. Corbin
*Attorney, Agent, or Firm*—D. F. Straitiff

[57] ABSTRACT

A slightly negatively buoyant personnel-accommodating chamber is suspended from a pair of buoyant-link flexible drive loops engaging the under surface of an ice cover over the body of water in which the chamber is submerged. Propulsion of the chamber can be effectuated through the medium of a power driven sprocket wheel arrangement that propels the chamber along the buoyant drive loops which in turn are caused to "roll" along the under surface of the ice.

5 Claims, 1 Drawing Figure

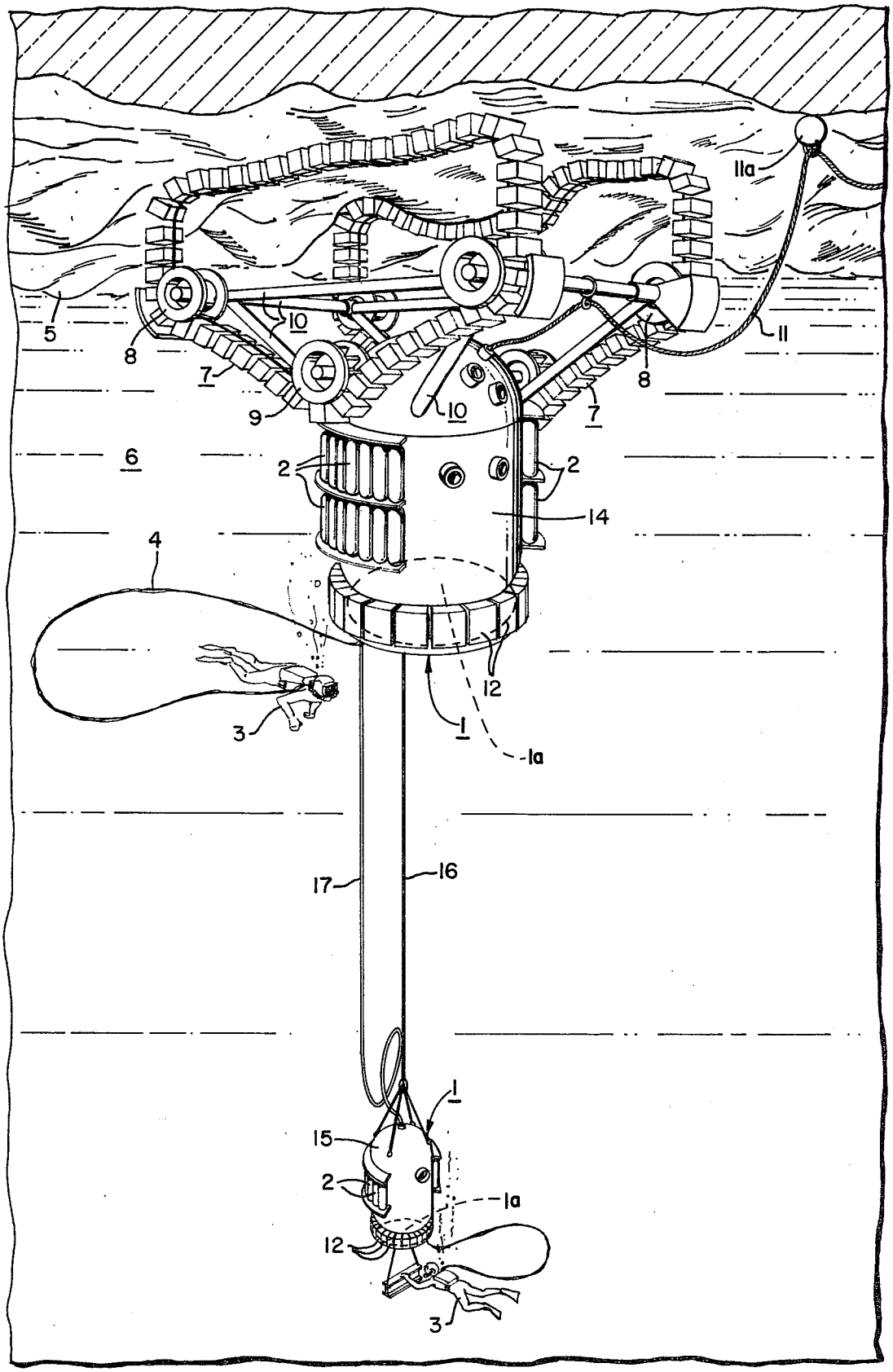
11a
5
10
11
8
7
8
9
10
7
6
2
2
14
4
12
3
1
1a
17
16
1
15
2
1a
12
3

UNDER-ICE TRAVELING SHELTER SYSTEM

CROSS-REFERENCE TO RELATED APPLICATION

Copending patent application, Ser. No. 815,389, filed concurrently herewith (W. E. Case 45,457) of William S. Hamel, assigned to the same assignee as this application, discloses a specific under-ice diver shelter system.

BACKGROUND OF THE INVENTION

1. Field of the Invention

This invention relates to an underwater chamber system for diving personnel and more particularly to one capable of movement along the under surface of an ice cover.

2. Description of the Prior Art

Under-ice operation by divers and manned submersibles require horizontal and vertical mobility in a forbidding environment. Availability of breathing gas, power, and supplies are necessary and the need for frequent returning to a surface base via an opening through the ice or to a mother submarine base tends to introduce an extremely high degree of difficulty with respect to performance capabilities of such divers. As far as the present inventor is aware, no prior art apparatus specific to mobile operation under ice for diver support has been made available or conceptualized. An on-bottom chain-loop-driven chamber disclosed in U.S. Pat. No. 3,543,526 to W. J. O'Neill et al is adapted particularly for diver support activity within a limited range of the bottom of the body of water in which the support chamber apparatus is located.

SUMMARY OF THE INVENTION

The present invention in providing an under-ice traveling diver support system that is capable of horizontal movement along the under surface of the ice in a body of water in which divers may be working near the under surface of such ice affords a system not heretofore contemplated or provided. This coupled with the additional feature of providing a diver support chamber means that is also vertically movable provides an additionally advantageous system in which diver support can be provided at depth locations extending from the undersurface of the overhead ice all the way to the bottom of the body of water involved within diver survival limits.

BRIEF DESCRIPTION OF THE DRAWINGS

The single FIGURE is a three dimensional view of a submerged traveling shelter system of the present invention affiliated with the underside of an ice layer covering the body of water in which the system is submerged.

DESCRIPTION OF THE PREFERRED EMBODIMENT

In polar regions, extensive ice formations form a formidable barrier to movement of men and equipment between the surface and areas of interest in the water column around the sea floor beneath such ice formation. Normally, access to the under ice region is obtained by penetration of the ice sheet with a hole formed explosively, thermally, or mechanically and by passage of divers, equipment, etc. through the hole. Supporting personnel and materials such as shelters, power generators, provisions, communications, and so on are sited on the ice near the hole, forming a support base for the operation. Area under the ice accessible to the operation is sharply limited by the difficulty and hazard associated with any significant lateral excursion away from the hole, or by the need to move surface equipment laterally and to derive a new hole. The use of divers in particular is limited because of this, since divers must be supplied with heat, power, communications, and often breathing gas in order to survive and function in this hostile environment; in addition, their energy and mobility are not adequate for lengthy excursions, and their navigational capability is low.

The present invention contemplates the provision of a diver support chamber means 1 of open-bottom construction to accommodate entrance of the divers through the bottom; having the usual diver access opening means 1*a* (show in dash line) at the lower end and otherwise closed to contain breathing gas within at sufficient pressure to maintain the ambient water excluded from the interior of the chamber means. In the well-known manner the breathing gas may be stored on the exterior of the chamber means in pressurized canisters 2 and the usual means (not shown) provided in affiliation with the chamber means to automatically maintain the proper breathing gas mixture and pressure within the chamber means 1. The chamber means 1 also may contain suitable working tools and equipment for the divers 3 that may enter and leave the chamber means in accord with the desires and needs. The diver or divers 3 may be provided with an umbilical 4 that originates at the interior of the diver support chamber means 1 to convey breathing gas at the interior of the chamber means to and from the diver, as well as heating water to maintain diver comfort and/or hydraulic or electric power lines for operation of diveroperated tools.

In accord with a feature of the present invention, the chamber means 1 in its general aspects is in effect suspended from and movable along the underside of the ice layer 5 covering the body of water 6 in which the chamber means 1 is disposed. As illustrated in the drawing, the buoyant means for supporting the chamber means 1 at the underside of the ice layer 5 and the means for propelling such chamber means along the underside of such layer are one and the same and in the form of a pair of flexible buoyant drive loops 7 that pass through idler rollers 8 and drive sprocket wheels 9 affiliated with the chamber means 1 and which extend upwardly into abutment with the under surface of the ice layer 5. Powered actuation of the drive loops 7 by rotation of the drive sprockets 9 cause such loops to travel around the idler wheels or pulleys 8 and the simultaneous laying down and taking up of portions of such loops to and from the under surface of the ice layer and in effect cause "rolling" of the chain loops along such under surface in somewhat of a caterpillar tractor tread fashion. The buoyance of the flexible drive loops is afforded by making such loops out of a series of articulated sections of buoyant solid material, for example, such as foam material. A suitable framework 10 interconnects the idler pulleys 8 with the chamber means 1 in a manner which tends to maintain the chamber means 1 in the desirable vertical attitude as supported by the drive loops 7 either in the static or traveling state.

As shown in the drawing, it will be seen that a considerable portion of the flexible buoyant drive loops project upwardly from the idler pulleys 8 and that this upwardly buoyant portion of such loops gives freedom for the ice-layer-contacting portions of the loops to comply with a considerable degree of irregularity of the under surface of the ice layer 5 without influencing the manner and equilibrium of support of the chamber means 1.

Power for operating the drive loops 7 and/or auxiliary equipment utilized by or for the divers 3 can be made available to the chamber means 1 by way of a power supply cable 11 extending from a remote base station site (not shown) such as a surface site, for example, and maintained in extension along the under side of the ice layer 5 by means of buoyant cable support elements or floats 12. Otherwise, such power may be furnished by batteries stowed on the chamber means 1.

In accord with a feature of the present invention the chamber means 1 is made at least slightly negatively buoyant, as by the inclusion of weights 12 shown in the drawing as being carried at the lower end of the chamber means at its exterior. Such location of the weights tends to maintain the proper vertical orientation of the chamber means. The weights 12 also might be represented by the power storage batteries when the same are utilized. Such negative buoyance enables the chamber means 1 to be suspended from the buoyant drive loops 7 pressing upwardly against the under surface of the ice layer 5. Should the depth of the body of water beneath the under surface of the ice layer 5 be shallow, and/or the depth of interest in diver excursion be limited, a single, vertically-immobile chamber 14 may constitute the diver support chamber means 1. However, where the depth below the ice layer 5 may be relatively great, then it is desirable that the divers 3 work from different levels in behalf of convenience or necessity. The chamber means 1 may be adjustable vertically relative to the point of support at the buoyant drive loops 7. At least in part this may be accomplished, as exemplified in the drawing, by providing an auxiliary chamber 15 as part of the overall diver support chamber means 1. The chamber 15 can be suspended by cable 16 from a takeup and play-out winch means (not shown) affiliated with the chamber 14, and a supply cable 17 can be played-out from the chamber 14 to provide power, chamber heating fluid, breathing gas, etc., as required or as desired. It will be understood that the auxiliary chamber 15 also is of open-bottom construction to accommodate entrance of the divers through the bottom and contains the breathing gas under suitable pressure which prevents filling of the chamber 15 with the ambient water surrounding it. Chamber 15 also is maintained negatively buoyant as by provision of the weights 12 at its lower end in order to enjoy suspended support by the cable 16 and an advantage of tethered vertical location thereby.

In operation of the diver support system of the present invention, suitable equipment can be moved to a select site on top of the ice cover 5 and a hole through such ice layer provided as by use of explosives, for example. The diver support chamber means 1, together with the framework 10 and flexible buoyant drive loops 7 can then be lowered through the hole in the ice. Initially, the chamber means 1 may be conditioned to be slightly positively buoyant with the flexible buoyant drive loops 7 slack at this point. The framework 10 at the upper end of the chamber means 1 will thus tend to be supported upwardly against the bottom surface of the ice layer. Once the equipment is checked out, the chamber means 1 can be readied for use and made transportable by addition of some of the weights 12 to cause the chamber means 1 to lower somewhat under the flexible buoyant drive loops into a downwardly stretched attitude of readiness for operability, as shown in the drawing. The drive sprockets 9 may then be rotated by the power means (not shown) to cause the flexible buoyant drive loops 7 to travel around the idler pulley wheels 8 and cause propulsion of the chamber means along the under surface of the ice layer 5 by what may be likened to a rolling motion of the drive loops along the under surface of the ice layer. By selective operation of the two drive sprockets 9, movement of one or the other of the drive loops may be effectuated to obtain steering of the chamber means while being caused to move along the under surface of the ice layer. The power cable and/or breathing gas line 11 can be played-out from the base station atop the ice layer as the chamber means 1 progresses along the under side of such layer. If desired, the chamber 14 can be made positively buoyant to bring the idler rolls 8 upwardly against the under surface of the ice for positive anchoring thereagainst if desired. At the same time, the previously mentioned, at least a portion of the chamber means, auxiliary chamber 15, for example, can be moved vertically by reel-in and play-out of the support cable 16 to suit a desired depth of operation for the diver support chamber means in accord with needs of the divers 3 utilizing such chamber means.

In lieu of the base station located on the upper surface of the ice layer adjacent to a hole therein, a submarine base may be located beneath the ice layer and the system or of apparatus of the present invention be deployed relative to such submarine base, in substantially the same manner as before described.

At the end of a given mission the sequence may be reversed to return the chamber means and drive loops therefor to the base station either at a submarine site or on the surface of the ice layer 5 through a hole therein (not shown).

Although the present invention has been described with a certain degree of particularity, it should be understood that the present disclosure has been made by way of example. It is therefore contemplated that various modifications and alterations be embraced within the scope of the appendant claims without departing from the spirit of the present invention.

What is claimed as the invention is:

1. An under-ice traveling shelter system comprising, a submersible breathing-gas-containing negatively-buoyant diver support chamber means of open-bottom construction for diver entrance, flexible buoyant loop means for rollable traction engagement with the undersurface of an ice layer on a body of water, a framework attached to said chamber means and extending thereabove, roller means on said framework in support by said loop means, and drive means operable to move said loop means past said roller means to advance said chamber means by rolling of said loop means on the ice layer undersurface.

2. The under-ice traveling shelter system of claim 1, wherein:

said diver support chamber means is vertically movable relative to said buoyant loop means.

3. The under-ice traveling shelter system of claim 1, wherein:

said diver support chamber means includes two diver support chambers, one of which is directly affiliated with said buoyant loop means and the other of which is suspended from the first chamber means via a cable susceptible to pay-out and reel-in.

4. The under-ice traveling shelter system of claim 1, wherein:

the system further includes a flexible cable means extending from a remote site to the aforesaid diver support chamber means.

5. The under-ice traveling shelter system of claim 1, wherein:

an umbilical extends from the interior of said diver support chamber means to a diver at the exterior thereof.

* * * * *